US006155793A

United States Patent [19]

Tuckey et al.

[11] Patent Number: 6,155,793

[45] Date of Patent: Dec. 5, 2000

[54] RECESSED FUEL PUMP MODULE

[75] Inventors: Charles H. Tuckey, Sand Point; Joseph M. Ross, Millington; Edward J. Talaski, Caro; Steven R. Tuckey, Essexville, all of Mich.

[73] Assignee: Walbro Corporation, Cass City, Mich.

[21] Appl. No.: 09/327,880

[22] Filed: Jun. 8, 1999

[51] Int. Cl.[7] ..... F04B 23/08

[52] U.S. Cl. ..... 417/87; 417/89; 123/509

[58] Field of Search ..... 123/509, 514, 123/574, 568; 417/87, 89; 137/143

[56] References Cited

U.S. PATENT DOCUMENTS

| | | | |
|---|---|---|---|
| 4,860,714 | 8/1989 | Bucci | 123/514 |
| 5,070,849 | 12/1991 | Rich et al. | 123/509 |
| 5,080,077 | 1/1992 | Sawert et al. | 123/514 |
| 5,139,000 | 8/1992 | Sawert | 123/514 |
| 5,218,942 | 6/1993 | Coba et al. | 123/514 |
| 5,219,277 | 6/1993 | Tuckey . | |
| 5,257,916 | 11/1993 | Tuckey . | |
| 5,330,475 | 7/1994 | Woodward et al. | 417/89 |
| 5,341,842 | 8/1994 | Chih et al. | 123/574 |
| 5,377,650 | 1/1995 | Warner | 123/568 |
| 5,452,701 | 9/1995 | Tuckey . | |
| 5,960,775 | 10/1999 | Tuckey | 123/509 |
| 5,979,485 | 11/1999 | Tuckey et al. | 137/143 |

*Primary Examiner*—Teresa Walberg
*Assistant Examiner*—Leonid Fastovsky
*Attorney, Agent, or Firm*—Reising, Ethington, Barnes, Kisselle, Learman & McCulloch, P.C.

[57] ABSTRACT

A fuel pump module constructed to be disposed in a vehicle fuel tank has a primary fuel pump with a fuel inlet disposed adjacent the bottom of the module and a fuel outlet which delivers pressurized fuel to an engine and also a jet pump disposed in a recess of the module and closely adjacent the bottom of the fuel tank to draw fuel into the module from the fuel tank in response to fuel flow through the jet pump. Disposing the jet pump in the recess of the module and closely adjacent to the bottom of the fuel tank enables the jet pump to draw substantially all of the fuel from the fuel tank into the module to ensure that the primary fuel pump can deliver an adequate supply of fuel to the engine even during extremely low fuel level conditions in the fuel tank. Disposing the inlet of the primary fuel pump closely adjacent to the bottom of the module and also the bottom of the fuel tank facilitates initial priming of the primary fuel pump after the fuel tank and module become empty and fuel is subsequently added to the fuel tank. Thus, after a vehicle has run out of gas, and the operator pours a small amount of gas into the gas tank, the primary fuel pump is able to prime, operate the jet pump to draw some of the added fuel into the module and deliver added fuel to the engine so that the engine may be started and the vehicle driven to a gas station.

24 Claims, 4 Drawing Sheets

RECESSED FUEL PUMP MODULE

FIELD OF THE INVENTION

This invention relates generally to fuel pumps and more particularly to a fuel pump and a fuel pump module constructed to be disposed in a fuel tank.

BACKGROUND OF THE INVENTION

Electric motor fuel pumps have been disposed in vehicle fuel tanks to draw fuel from the fuel tanks and deliver it under pressure to an engine. Some fuel pumps have been received in fuel reservoirs or modules disposed within the fuel tank for holding a supply of fuel such as disclosed in U.S. Pat. No. 5,452,701. A primary pumping assembly draws fuel directly through an opening through the module. A portion of the fuel pressurized by the primary pumping assembly is routed through a jet pump which creates a pressure drop also tending to draw fuel into the jet pump. Fuel discharged from the jet pump is maintained in the module and may be drawn into the fuel pump for delivery to the engine.

In prior fuel pump module and fuel pump constructions, the jet pump has been located too far above the bottom of the fuel tank thus inhibiting the ability of the jet pump to draw fuel from adjacent the bottom of the fuel tank into the module or pump. This prohibits priming of the fuel pump at a low fuel level in the tank and particularly after the vehicle engine has run out of fuel and a small quantity of fuel, such as 2 liters to one gallon, has been added to the "empty" fuel tank to restart the engine and drive a short distance to a fuel dispensing station to refill the tank.

SUMMARY OF THE INVENTION

A fuel pump module constructed to be disposed in a vehicle fuel tank has a primary fuel pump with a fuel inlet disposed adjacent the bottom of the module and a fuel outlet which delivers pressurized fuel to an engine and also to a jet pump disposed in a recess of the module and closely adjacent the bottom of the fuel tank to draw fuel into the module from the fuel tank in response to fuel flow through the jet pump. Disposing the jet pump in the recess of the module and closely adjacent to the bottom of the fuel tank enables the jet pump to draw substantially all of the fuel from the fuel tank into the module to insure that the fuel pump can deliver an adequate supply of fuel to the engine even during extremely low fuel level conditions in the fuel tank. Disposing the inlet of the fuel pump closely adjacent to the bottom of the module and also the bottom of the fuel tank facilitates initial priming of the fuel pump after the fuel tank and module become empty and a small quantity of fuel is subsequently added to the fuel tank. Thus, after a vehicle has run out of gas, and the operator pours a small amount of gas such as two liters to one gallon into the gas tank, the fuel pump is able to prime and draw some of the added fuel into the primary fuel pump and deliver it to the engine so that the engine may be started and the vehicle driven to a gas station.

The fuel pump module and fuel pump construction enables substantially all of the fuel in a vehicle fuel tank to be delivered to an engine to enable operation of the engine even when there is an extremely low fuel level in the fuel tank. Further, the position of the jet pump and primary fuel pump inlet adjacent to the bottom of the fuel tank reduces the air or fuel vapor drawn into the primary fuel pump to reduce the fuel vapor delivered from the primary fuel pump and to improve the hot fuel handling capability of the fuel pump module.

Objects, features and advantages of this invention include providing a fuel pump module construction which facilitates priming the fuel pumps, enables substantially all of the fuel within a fuel tank to be delivered to an engine, reduces fuel vapor drawn into and delivered from the fuel pump, improves the performance of the fuel pump module in hot fuel conditions, improves the efficiency of the fuel pump module and is of relatively simple design and economical manufacture and assembly.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
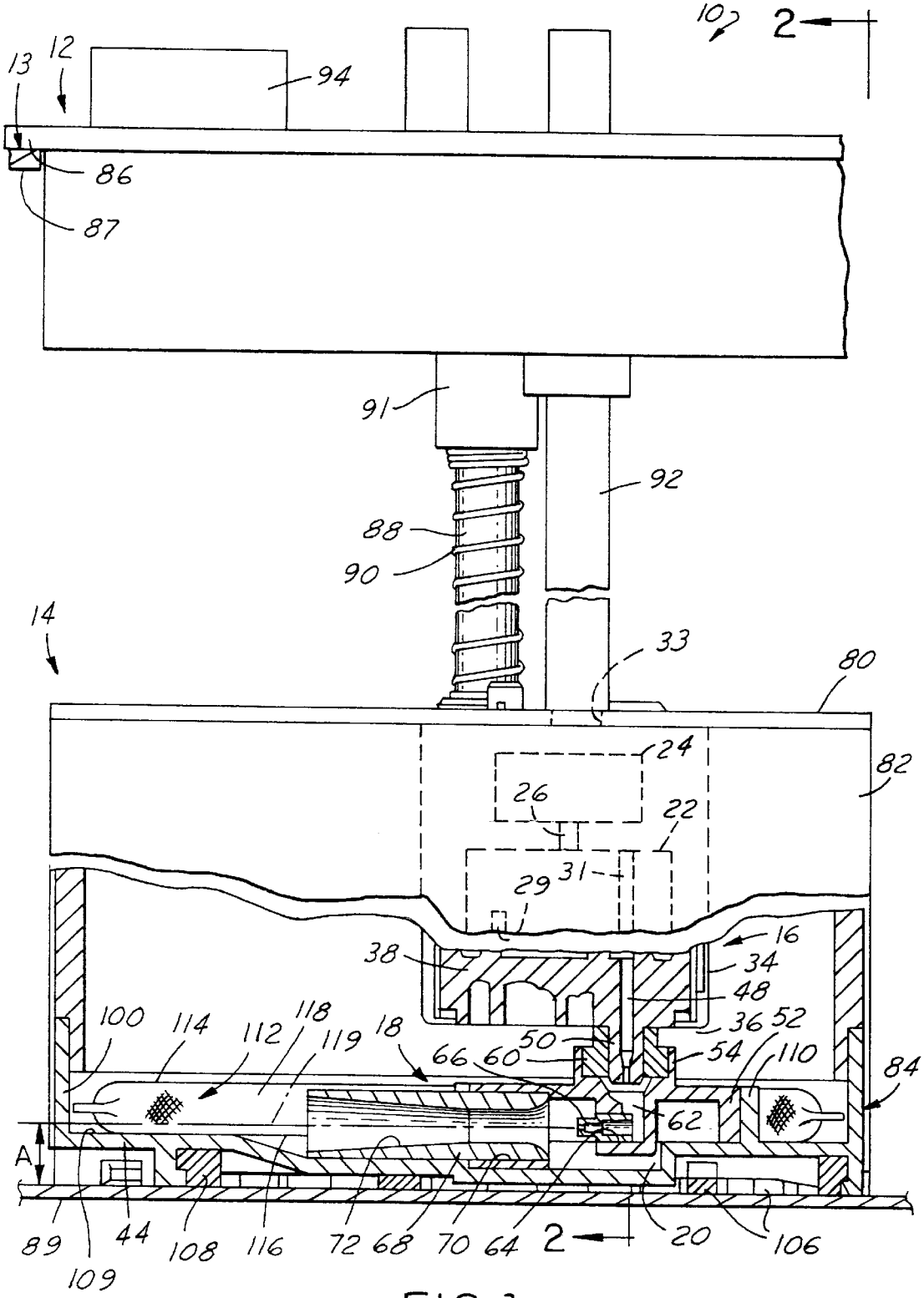
FIG. 1 is a fragmentary view with parts in section of the fuel pumps and fuel pump module embodying this invention.

Referring in more detail to the drawings, FIG. 1 illustrates a fuel pump module 10 having a flange portion 12 constructed to be carried by and sealed to a fuel tank 13, a reservoir portion 14 constructed to be disposed within the fuel tank and containing an electric motor fuel pump 16 which draws fuel from the reservoir 14 and delivers it under pressure to both an engine of a vehicle and a jet pump 18 received in a recess 20 of the module 10 which functions to draw fuel into the reservoir 14 from the surrounding fuel tank. Thus, a portion of the pressurized fuel discharged from a primary fuel pumping assembly 22 of the electric fuel pump 16 drives the jet pump 18 to draw fuel into the reservoir 14 from the fuel tank. In turn, the fuel pump 16 draws fuel from the reservoir portion 14 and delivers it under pressure to an engine.

The fuel pump 16 preferably has an electric motor 24 which, through a shaft 26, drives the primary pumping assembly 22. The pumping assembly 22 has an inlet port 29 in communication with a fuel inlet 30 (FIG. 2) to draw fuel from the reservoir 14 through the fuel inlet 30 and into the inlet port of the fuel pump assembly 22. The pressure of the fuel in the fuel pump assembly 22 is increased and the pressurized fuel is discharged through an outlet port 31 of the pumping assembly 22 in communication with an outlet 33 of the fuel pump for delivery to an engine under pressure. The fuel pump 16 may be either a positive displacement type fuel pump, such as that disclosed in U.S. Pat. No. 5,219,277 or a turbine type fuel pump, such as disclosed in U.S. Pat. No. 5,257,916, the disclosures of which are incorporated herein by reference in their entirety.

Figure 2:
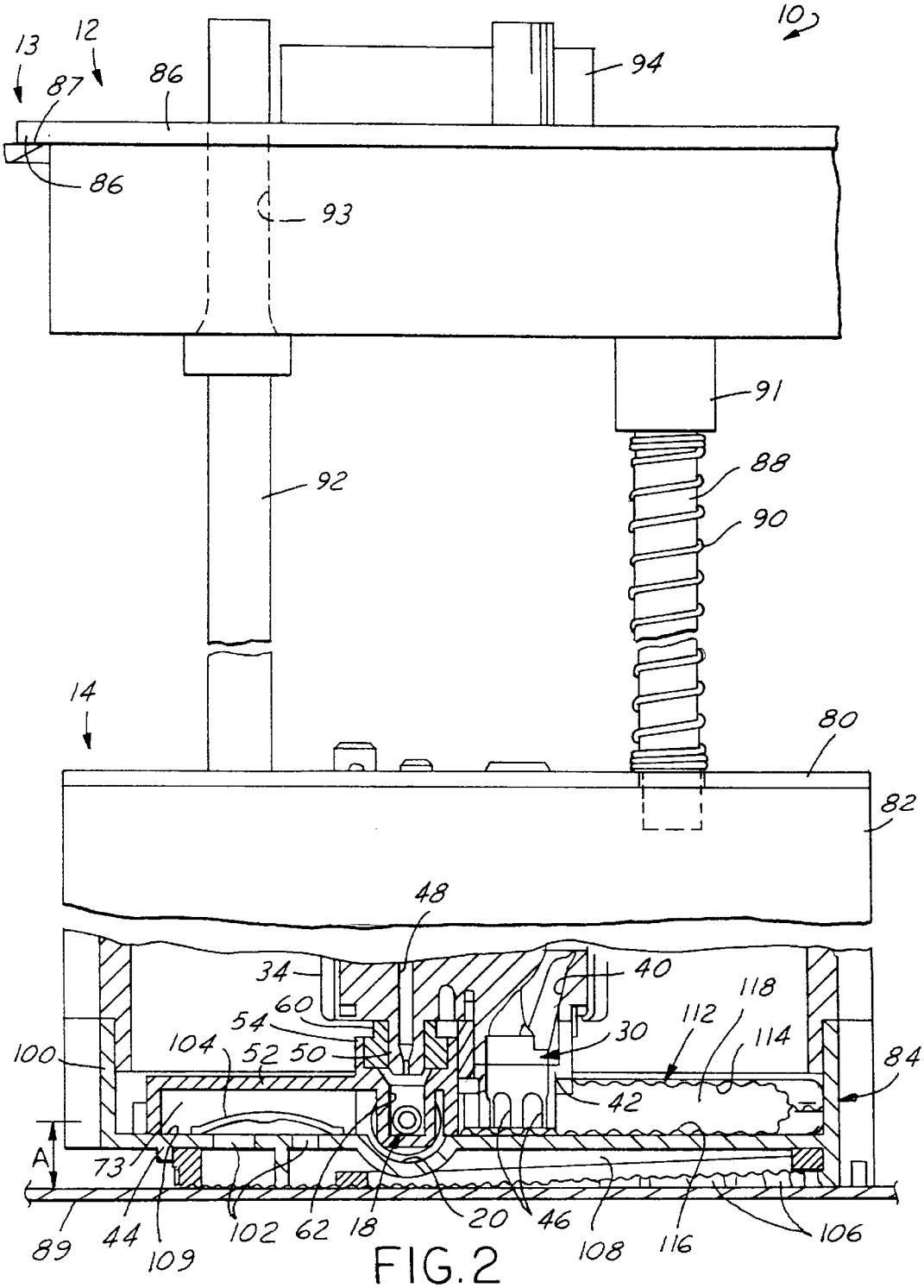
FIG. 2 is a fragmentary sectional view taken generally along line 2—2 of FIG. 1.

An outer shell 34 of the fuel pump 16 preferably encloses the electric motor 24 and fuel pumping assembly 22 and has one end 36 rolled around a peripheral edge of an inlet end cap 38. As shown in FIG. 2, the inlet end cap 38 has a fuel inlet passage 40 therethrough which communicates with the fuel inlet 30. An inlet body 42 which defines in part the fuel inlet 30 is preferably carried by the inlet end cap 38 and extends downwardly to a bottom wall 44 of the module 10. The body 42 has an open end spaced from the inlet end cap 38 and a plurality of slots 46 through which fuel is drawn into the fuel pump 16. To provide fuel under pressure to operate the jet pump, a passage 48 through the inlet end cap 38 communicates the outlet port 31 of the fuel pumping assembly 22 with the jet pump 18. This passage 48 preferably extends through a depending projection 50 of the inlet end cap 38 to facilitate connection between the end cap 38 and a housing 52 which carries the jet pump 18.

Figure 4:
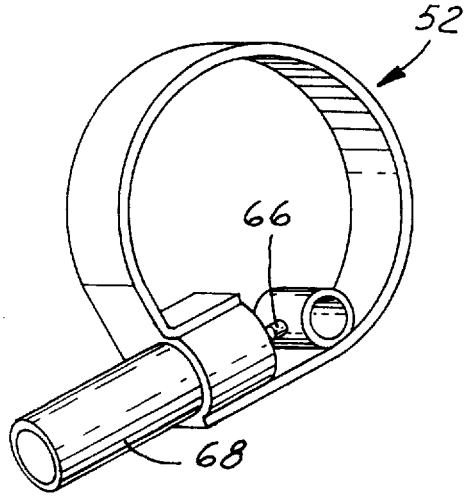
FIG. 4 is a perspective view illustrating the bottom of a jet pump housing.

To connect the jet pump housing 52 to the inlet end cap 38, the housing 52 has a generally upstanding skirt 54 constructed to be pressed onto a grommet 60 press fit on the projection 50 of the inlet end cap 38. So connected, the passage 48 communicates with a cavity 62 in the jet pump housing 52 having an opening 64 in which a jet or nozzle 66 is press fit. The nozzle 66 is constructed to discharge fuel through a venturi tube press 68 fit in an opening 70 formed through a sidewall portion of the housing 52 as shown in FIGS. 1 and 4. The venturi tube 68 has a generally tapered passage 72 with a converging inlet, a throat with a reduced diameter central portion and a diverging outlet with an increasing diameter downstream of the throat to create a pressure drop in a chamber 73 defined by the housing 52 when fuel discharged from the nozzle 66 flows through the venturi 68. As shown in FIG. 2, the jet pump 18 may be laterally spaced from the fuel pump inlet 30 such that fuel drawn into the pump inlet 30 is not directly communicated with the jet pump 18.

The flange portion 12 of the module 10 has an outwardly extending flange 86 constructed to overlie and to be sealed to an upper wall 87 of the fuel tank. The flange portion 12 is interconnected with the reservoir portion 14 by a shaft 88 preferably fixed to a projection 91 of the flange portion 12 and slidably received in an opening through an upper cap 80 of the reservoir portion 14. A spring 90 on the shaft 88 biases the reservoir portion 14 away from the flange portion 12 to dispose the reservoir portion 14 on the bottom wall 89 of the fuel tank. This so-called "bottom referencing" accommodates variations in the vertical distance from the bottom to the top of the tank and from tank to tank to ensure the bottom of the module 14 always bears on the bottom wall 89 of the tank. A flexible fuel hose 92 interconnects the fuel pump outlet with an outlet tube 93 through the flange portion 12 to deliver fuel from the fuel tank to the engine. An elliptical skirt 94 is constructed to receive an electrical connector to provide power to the fuel pump electric motor 24.

The reservoir portion 14 of the fuel pump module 10 his an upper cap 80, a sidewall 82 and a lower end cap 84 which define a fuel reservoir which receives fuel discharged from the venturi tube 68. The sidewall 82 is preferably generally cylindrical. The cap 80 may have an opening 96 (FIG. 3) permitting fuel flow between the tank and the top of the reservoir 14.

Figure 3:
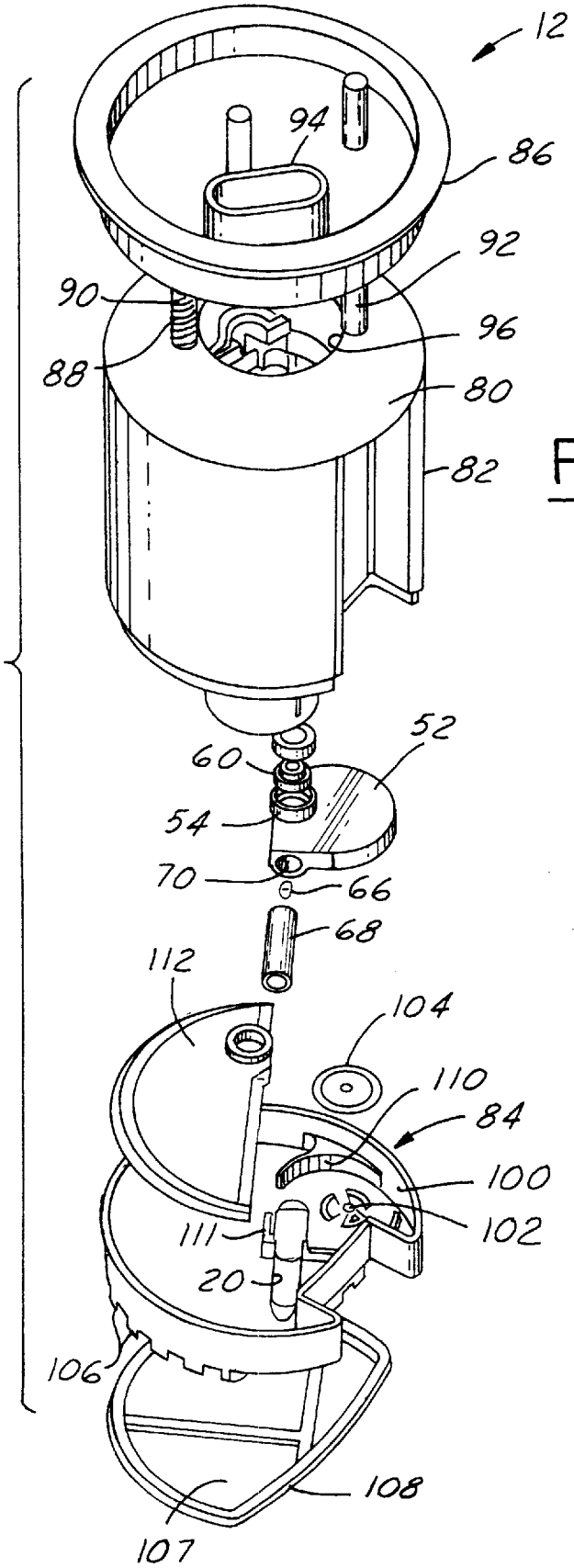
FIG. 3 is an exploded view of the fuel pump module of FIG. 1.

The lower end cap 84 of the module 10 has the bottom wall 44 with the recess 20 formed therein and a peripheral skirt 100 extending therefrom and constructed to be telescopically received on a portion of the sidewall 82 of the module 10. As best shown in FIG. 3, to locate in assembly the housing 52 of the jet pump 18, a generally arcuate wall 110 and a spaced apart dogleg wall 111 are provided on the end cap 84 to telescopically receive the jet pump housing 52 in assembly. Fuel inlet openings 102 through the bottom wall 44 are covered by an umbrella type check valve 104 which permits a relatively free flow of fuel into the chamber 73 while preventing the reverse flow of fuel from the chamber 73 into the fuel tank. Fuel in the chamber 73 is drawn into the jet pump 18 and discharged through the venturi tube 68 into the reservoir module 14 whereupon it may be drawn into the primary fuel pump 22. Spaced apart feet 106 depending from the bottom wall 44 of the lower end cap 84 preferably provide the lowermost portion of the end cap 84 to space the bottom wall 44 from the fuel tank and provide fuel flow paths through which fuel in the tank communicates with the fuel inlet openings 102. A frame 108 may be fixed to or carried by the end cap 84 and is constructed to be received adjacent the bottom of the fuel tank. To filter fuel drawn into the jet pump 18, a sheet 107 of filter material may be fixed to the frame 108.

Preferably, a fuel filter 112 is carried by the lower end cap 84 generally surrounding the fuel pump inlet body 42 so that fuel is filtered prior to being drawn into the primary fuel pump 22. The fuel filter 112 preferably has an upper wall 114 and a lower wall 116 defining an enclosure 118 in which the inlet body 42 is received. The filter material preferably has an average pore size of about 30 to 70 microns. When wet, the liquid capillary action of the wetted filter material substantially prevents air or fuel vapors from passing through the filter to prevent excessive air or fuel vapors from being drawn into the fuel pump during extremely low fuel level conditions in the fuel tank when some or all of the filter is not immersed in liquid fuel. Under these conditions, the filter tends to collapse and may block the primary fuel pump inlet 30. To prevent this, the end of the inlet body 42 holds the lower wall 116 of the filter 112 against the bottom wall 44 of the end cap 84 to prevent the filter 112 from blocking the fuel pump inlet 30 or being drawn into the fuel pump inlet 30.

Advantageously, the recess 20 in the end cap 84 receives at least a portion of the venturi tube 68 and the cavity 62 of the jet pump housing 52 which carries the nozzle 66 to dispose the nozzle 66 and venturi tube 68, which comprise the jet pump 18, closely adjacent to the bottom wall 44 of the module 10 and hence the bottom wall 89 of the fuel tank. Desirably, the nozzle 66 and venturi tube 68 are generally coaxially aligned with their axes 119 closely adjacent to an inside surface 109 of the bottom wall 44 of the end cap 84. Preferably, the axes 119 of the nozzle 66 and venturi tube 68 are located 0.5 of an inch or less from the lowest portion of the end cap 84 (as indicated by dimension 'A' in FIGS. 1 and 2) which is constructed to engage the bottom wall 89 of the fuel tank, thus positioning the nozzle 66 and venturi tube 68 the same distance from the bottom of the fuel tank.

As shown, the jet pump 18 is laterally spaced from the fuel pump inlet 30 and located closely adjacent to the bottom wall 44 of the module end cap 84 and hence, closely adjacent to the bottom wall of the fuel tank. This facilitates drawing substantially all of the fuel from the fuel tank into the module reservoir 14 to permit the primary fuel pump 16 to draw substantially all of the fuel from the tank and deliver it to an engine for operation of the engine even when there is an extremely low fuel level within the fuel tank. Further, the fuel inlet 30 is also disposed closely adjacent to the bottom wall 44 of the module end cap 84 and hence, closely adjacent to the bottom wall of the fuel tank to facilitate initial priming of the fuel pump 16 when fuel is first added to the fuel tank or when the fuel tank and reservoir 14 are emptied of fuel, such as when the vehicle runs out of gas, and a small amount of fuel is poured into the fuel tank.

Typically, when the vehicle runs out of gas, the operator will obtain two liters to a gallon or so of gas at a station and empty it into the gas tank. This will provide a level of fuel in the fuel tank of about of ¾ of an inch to 1 inch. Even with this low level of fuel in the tank, the primary fuel pump 22 will be able to prime itself, actuate the jet pump 18 and draw this fuel into the pumping assembly 22 and deliver it under pressure to the engine so that the vehicle may be driven to a gas station to add additional fuel to the tank. This is important because without operation of the pumping assembly 22, there is no fuel flow through the jet pump 18 and hence, no pressure drop drawing fuel from the fuel tank into the module. Therefore, the primary fuel pump 22 must be able to initially prime itself to draw an initial amount of fuel into the pumping assembly 22 so that a portion of the fuel discharged from the pumping assembly 22 may be used to drive the jet pump 18 and draw additional fuel into the module reservoir 14 to facilitate further operation of the primary fuel pump 22 to deliver outlet fuel through the line 92 to the vehicle engine.

In addition to the above noted advantages, the position of the fuel pump inlet 30 adjacent the bottom of the fuel tank causes the inlet 30 to be submerged in fuel even during extremely low fuel level conditions in the fuel tank. This reduces the amount of air or fuel vapor drawn into the primary fuel pump 22 and hence, increases the efficiency of the fuel pump 22 and the pump module. Further. these and other advantages are achieved without any known disadvantages.

Figure 5:
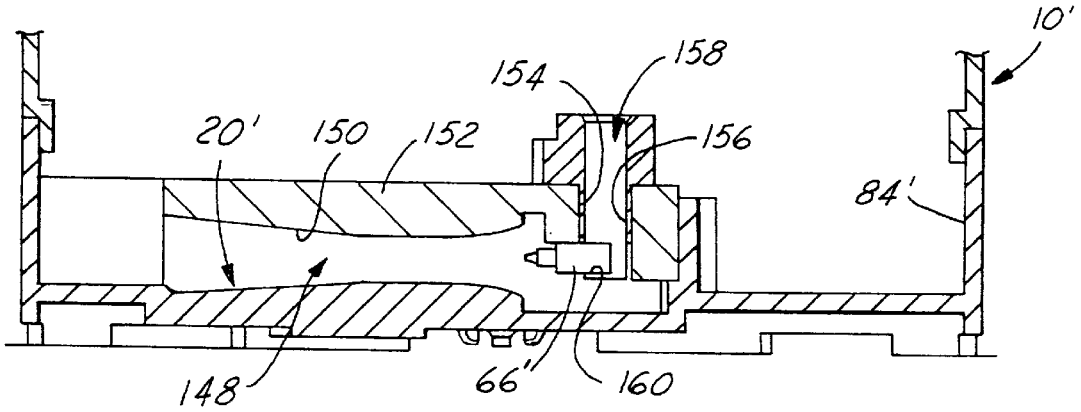
FIG. 5 is a fragmentary sectional view of a modified end cap of a fuel pump module according to an alternate embodiment of the invention.

As shown in FIG. 5, a modified end cap 84' of a fuel pump module 10' according to an alternate embodiment of the invention has a contoured recess 20' which defines a lower portion of a venturi 148. An upper portion of the venturi 148 is formed by an opposing contoured recess 150 formed in a jet pump housing or cover 152 thus, no separate venturi tube 68 is needed. The cover 152 has a bore 154 in which a depending projection 156 is received. The projection 156 has a passage 158 which communicates at one end with the outlet port of the fuel pumping mechanism (not shown in FIG. 5). A jet pump nozzle 66' is preferably press-fit into an opening 160 through a sidewall of the projection 156 to receive fuel from the passage 158 and discharge the fuel through the venturi 148 to create a pressure drop as described with reference to the module 10.

By forming the venturi 148 partially in the recess 20', the venturi tube can be eliminated and the jet pump can be positioned even lower in the fuel pump module and closer to the bottom wall of the fuel tank in which the module 10' is received. The fuel pump module 10' functions in the same manner as the module 10 and hence, its operation will not be further described.

Figure 6:
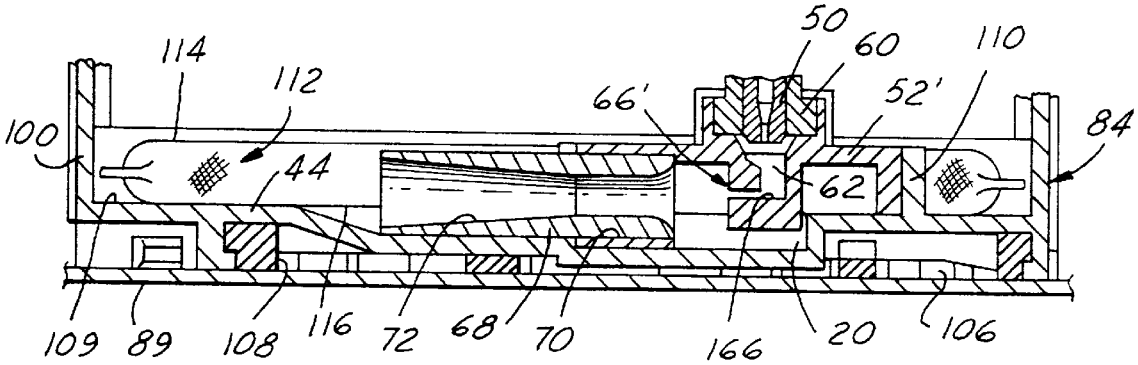
FIG. 6 is a fragmentary sectional view of a modified end cap of a fuel pump module according to another alternate embodiment of the invention.
Figure 7:
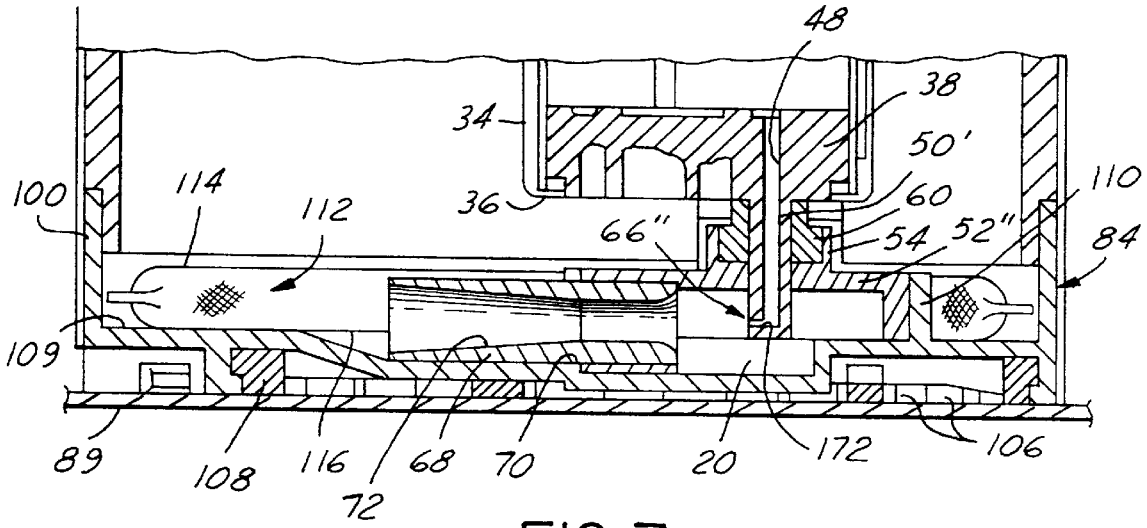
FIG. 7 is a fragmentary sectional view of a modified end cap of a fuel pump module according to still another alternate embodiment of the invention.

Additionally, as shown in FIG. 6, a nozzle 66' may be integrally formed in a modified jet pump housing 52' by forming a small passage 166 in the housing 52' which opens into the cavity 62. This eliminates the need for the separate nozzle 66 of the module 10 to reduce the number of components of the module 10. Similarly, as shown in FIG. 7, a nozzle 66" may be formed in a depending projection 50' of a modified inlet end cap 38' which extends through a bore 171 in a modified jet pump housing 52". The nozzle 66" preferably comprises a small passage 172 which communicates the passage 48 with a venturi 68 or 148. The separate nozzle 66 press-fit into the jet pump housing 52 as shown in FIGS. 1–4 is eliminated to reduce the number of components of the fuel pump module. Besides the above noted differences, each of the embodiments shown in FIG. 6 and FIG. 7 is constructed the same as the module 10 and functions in the same manner as the module 10 and hence, their operation will not be described further.

What is claimed is:

1. A fuel pump module, comprising:

a reservoir constructed to be disposed in a fuel tank having a bottom wall, said reservoir having a sidewall connected to a bottom wall to define a fuel reservoir, the bottom wall has a recess formed therein, and an opening immediately adjacent the bottom wall of the fuel tank and permitting fuel to enter the fuel reservoir;

a jet pump at least partially received in the recess formed in the bottom wall and constructed to draw fuel into the fuel reservoir through the opening; and a primary fuel pump carried by the reservoir and having an inlet through which fuel is drawn from the fuel reservoir and an outlet through which fuel is discharged under pressure, whereby the recess in the bottom wall permits the jet pump to be received closely adjacent to the bottom wall of the reservoir and the bottom wall of the fuel tank.

2. The module of claim 1 wherein the jet pump comprises a nozzle having an outlet and a venturi downstream of the nozzle outlet and having a non-uniform passage formed therethrough in communication with the nozzle outlet to create a drop in pressure adjacent the venturi when fluid discharged from the nozzle outlet flows through the venturi, and the venturi is at least partially received in the recess.

3. The module of claim 2 wherein the nozzle outlet and the venturi are generally coaxially aligned with such axis spaced from a lowermost portion of the reservoir by 0.5 inches or less.

4. The module of claim 1 wherein the fuel pump inlet is disposed closely adjacent to the bottom wall to facilitate priming the fuel pump.

5. The module of claim 1 wherein the fuel pump inlet is laterally spaced from the jet pump such that fuel drawn into the fuel pump inlet is not directly communicated with the jet pump.

6. The module of claim 1 which also comprises a fuel filter disposed adjacent the fuel pump inlet to filter fuel before it is drawn into the fuel pump.

7. The module of claim 2 which also comprises a filter adjacent the venturi and constructed to filter fuel before it has passed through the passage of the venturi.

8. The module of claim 1 which also comprises a flange portion of the fuel pump module interconnected with the reservoir portion and constructed to be fixed to a wall of a fuel tank, the reservoir portion being yieldably biased away from the flange portion and adapted to be engaged with a bottom wall of a fuel tank.

9. The module of claim 2 wherein the inlet of the primary fuel pump is at least partially formed in an inlet end cap and the nozzle and venturi are separated from the inlet end cap.

10. The module of claim 2 wherein the venturi is defined at least in part by the recess.

11. The module of claim 10 which also comprises a cover having a recess generally opposed to said recess in the bottom wall of the reservoir to define the venturi between the cover and bottom wall of the reservoir.

12. The module of claim 2 wherein the venturi is defined in a tube at least partially received in the recess.

13. A fuel pump module constructed to be disposed in a vehicle fuel tank having a bottom wall, the fuel pump module comprising:

a reservoir constructed to be disposed in the fuel tank and having a sidewall connected to a bottom wall to define a fuel reservoir, the bottom wall of the reservoir has an opening and is disposed immediately adjacent the bottom wall of the fuel tank;

a primary fuel pump carried by the reservoir and having an inlet end cap in which is formed an inlet through which fuel is drawn from the fuel reservoir and an outlet through which fuel is discharged under pressure; and a jet pump carried by the reservoir and having a nozzle in communication with the outlet of the primary fuel pump and a venturi downstream of the nozzle, the nozzle and venturi are generally coaxially aligned with such axes spaced from the bottom wall of the fuel tank by 0.5 of an inch or less.

14. The module of claim 13 which also comprises a jet pump housing which carries the nozzle and venturi and is connected to the inlet end cap.

15. The module of claim 14 wherein the jet pump housing covers the opening in the bottom wall of the reservoir and defines a chamber which communicates with the opening and with the venturi and fuel that enters the reservoir through the opening flows through the venturi and into the fuel reservoir.

16. The module of claim 14 wherein the jet pump housing bears on the bottom wall of the reservoir.

17. The module of claim 14 wherein the venturi is defined in a tube and the jet pump housing has a pair of openings formed therein and the nozzle and tube defining the venturi are each press-fit into a separate opening.

18. The module of claim 14 wherein the jet pump housing is press-fit onto the inlet end cap.

19. The module of claim 14 wherein bottom wall of the reservoir has a recess formed therein and the venturi is defined at least in part by the recess.

20. The module of claim 19 wherein the jet pump housing has a recess formed therein opposed to and aligned with the recess in the bottom wall of the reservoir and the venturi is defined by the recess in the jet pump housing and the recess in the bottom wall of the reservoir.

21. The module of claim 2 which also comprises a jet pump housing which carries the nozzle and venturi tube with the nozzle being integrally formed with the jet pump housing.

22. The module of claim 2 which also comprises an inlet end cap carried by the primary fuel pump and having a depending projection which has a passage formed therein communicating the outlet of the primary fuel pump and a nozzle integrally formed with the inlet end cap and communicating with the passage in the depending projection to discharge fluid through the venturi.

23. The module of claim 14 wherein the nozzle is integrally formed in the jet pump housing.

24. The module of claim 13 wherein the nozzle is integrally formed with the inlet end cap in communication with the outlet of the inlet end cap.

* * * * *

UNITED STATES PATENT AND TRADEMARK OFFICE

CERTIFICATE OF CORRECTION

PATENT NO. : 6,155,793
DATED : December 5, 2000
INVENTOR(S) : Charles H. Tuckey et al.

It is certified that error appears in the above-identified patent and that said Letters Patent is hereby corrected as shown below:

Column 8,
Line 5, after "wherein" insert -- the --.

Signed and Sealed this

Sixth Day of August, 2002

*Attest:*

*Attesting Officer*

JAMES E. ROGAN
*Director of the United States Patent and Trademark Office*